US008814504B2

(12) United States Patent
Langgood et al.

(10) Patent No.: US 8,814,504 B2
(45) Date of Patent: Aug. 26, 2014

(54) FAN BRAKE

(75) Inventors: John K. Langgood, Cary, NC (US); Thomas F. Lewis, Raleigh, NC (US); Kevin M. Reinberg, Chapel Hill, NC (US); Kevin S. D. Vernon, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 507 days.

(21) Appl. No.: 13/249,735

(22) Filed: Sep. 30, 2011

(65) Prior Publication Data

US 2013/0084185 A1 Apr. 4, 2013

(51) Int. Cl.

| | |
|---|---|
| ***F04D 29/00*** | (2006.01) |
| ***F04D 25/06*** | (2006.01) |
| ***F04D 27/00*** | (2006.01) |
| ***F04D 29/60*** | (2006.01) |

(52) U.S. Cl.

CPC ..... *F04D 25/0613* (2013.01); *F04D 27/008* (2013.01); *F04D 29/601* (2013.01)

USPC ..... 415/123

(58) Field of Classification Search

CPC .. F04D 27/008; F04D 29/601; F04D 25/0613

USPC ..... 415/123, 122.1, 126; 416/169 R, 169 A, 416/140

See application file for complete search history.

(56) References Cited

U.S. PATENT DOCUMENTS

| | | | | |
|---|---|---|---|---|
| 3,560,109 | A * | 2/1971 | Lewis | 416/169 R |
| 3,826,934 | A * | 7/1974 | Leach | 310/41 |
| 5,921,753 | A | 7/1999 | Ames | |
| 6,422,814 | B1 | 7/2002 | Dickey et al. | |
| 6,435,889 | B1 | 8/2002 | Vinson et al. | |
| 6,983,828 | B2 * | 1/2006 | Baumann et al. | 188/70 B |
| 7,251,135 | B2 | 7/2007 | Crippen et al. | |
| 7,306,426 | B2 | 12/2007 | Franz et al. | |
| 7,611,328 | B2 | 11/2009 | Peng et al. | |
| 2002/0141879 | A1 | 10/2002 | Winkel et al. | |
| 2009/0284919 | A1 | 11/2009 | Tao et al. | |
| 2011/0077796 | A1 | 3/2011 | Aklilu et al. | |

FOREIGN PATENT DOCUMENTS

| | | | |
|---|---|---|---|
| DE | 19844643 | C1 | 1/2001 |
| EP | 0718958 | A2 | 6/1996 |

OTHER PUBLICATIONS

IBM. IP.com, Inc. "Hot Swap Fan with Impeller Auto-Stop Feature," IPCOM000030642D, Aug. 20, 2004.

* cited by examiner

*Primary Examiner* — Ned Landrum

*Assistant Examiner* — Brian O Peters

(74) *Attorney, Agent, or Firm* — Jason H. Sosa; Matthew Mottice

(57) ABSTRACT

A fan brake for a fan system. The fan system may include a fan assembly configured for seating into a cassette housing. The fan assembly may include a fan having a plurality of blades connected with a fan hub. The fan brake may be connected to the fan assembly, wherein the fan brake engages the fan hub when the fan housing is not fully seated within the cassette housing, and the fan brake disengages the fan hub when the fan assembly is fully seated into the cassette housing.

19 Claims, 6 Drawing Sheets

FAN BRAKE

FIELD OF THE INVENTION

The present invention relates generally to fans and more specifically to a fan brake for a fan system.

BACKGROUND

When operating, electronic components and central processing units in computer systems often generate heat, which may influence system performance or result in damage to internal and/or external components if the temperature reaches undesired levels. To combat the generation of heat, most computers have one or more fans that facilitate the dissipation of heat and keep electronics from overheating during use. In many cases, the computer fans may be critical for optimized use of the computer. As such, it is often undesirable to turn off a computer to fix or replace a fan.

One solution that does not require the computer to be turned off for maintenance issues is to employ the use of fans that are hot pluggable, i.e., the fans can be removed and replaced while power to the computer is still on. Hot-pluggable fans typically allow a repair to occur without disturbing the operation of the computer system. However, unless the person removing the fan allows the fan blade time to slow down and/or stop, the fan blade may be moving when removing the fan. This poses a risk of injury to the person removing the fan. To alleviate the risk, some fan housings include a finger guard such as a screen or other form of safety device that limits the opportunity for an individual's finger to reach a moving fan blade. However, the use of finger guards may diminish the efficiency of the fan by impeding the amount of airflow that a fan delivers for the same amount of power used.

SUMMARY

Aspects of the present invention disclose a fan brake for a fan system. The fan system may include a fan assembly configured for seating into a cassette housing. The fan assembly may include a fan having a plurality of blades connected with a fan hub. A fan brake may be connected to the fan assembly, wherein the fan brake engages the fan hub when the fan housing is not fully seated within the cassette housing, and the fan brake disengages the fan hub when the fan assembly is fully seated into the cassette housing.

DETAILED DESCRIPTION

The present invention will now be described in detail with reference to the figures.

Figure 1:
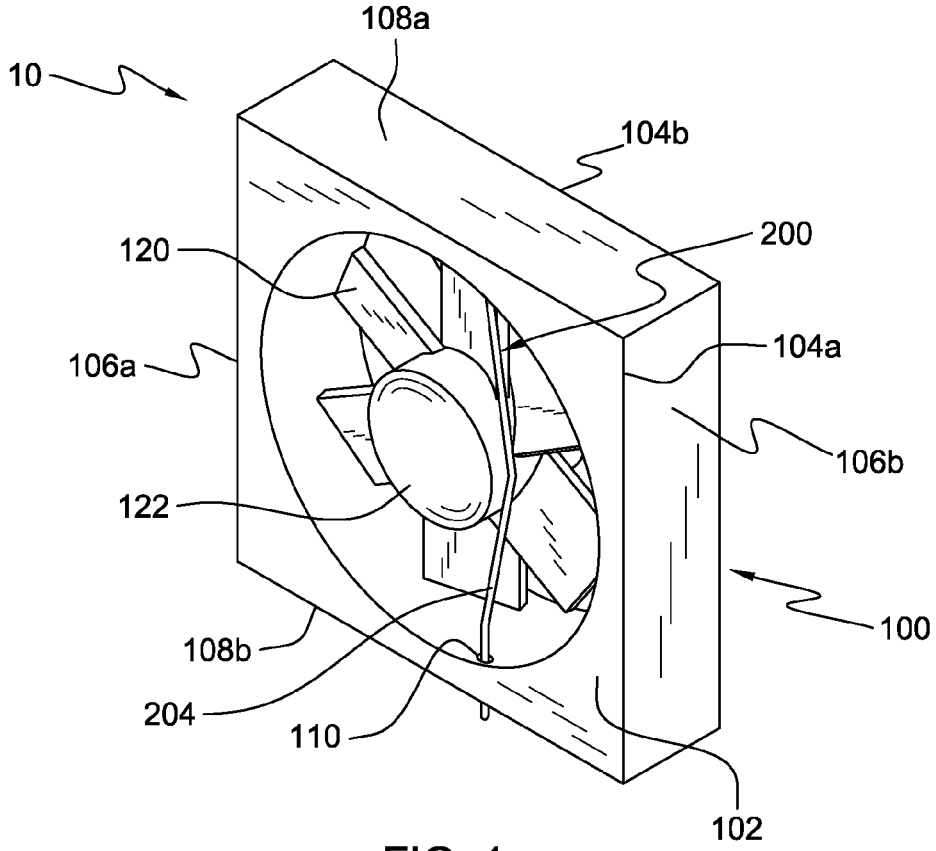
FIG. 1 depicts an example of a fan brake according to the present invention.
Figure 2:
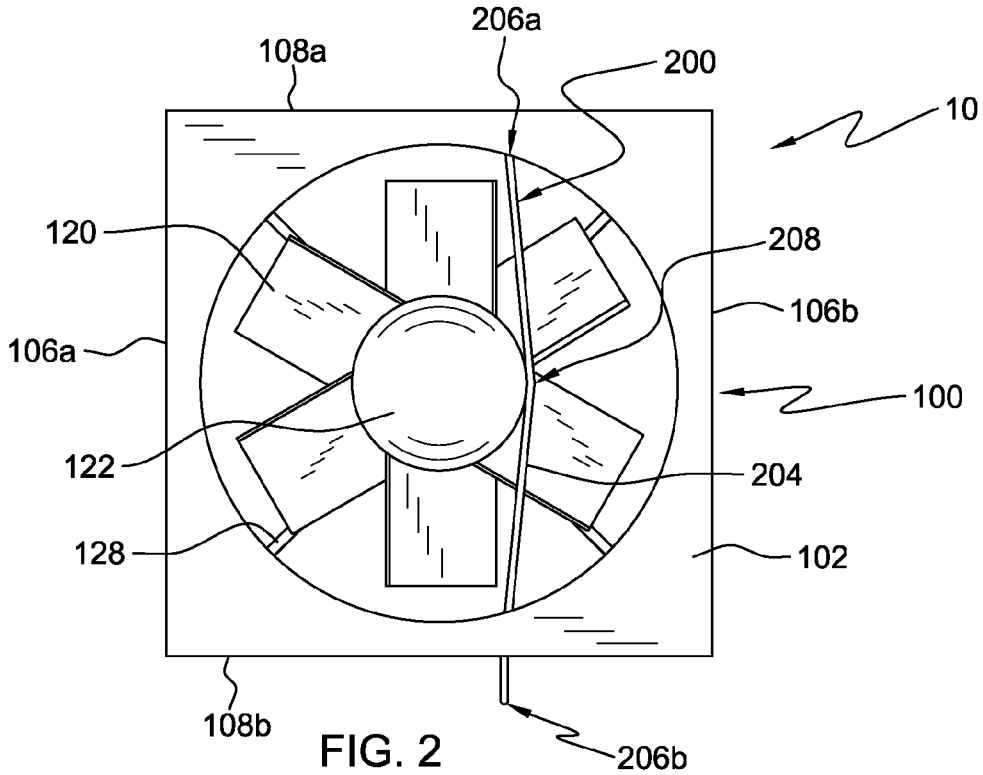
FIG. 2 depicts the fan brake of FIG. 1 prior to being fully seated within a housing according to the present invention.
Figure 3:
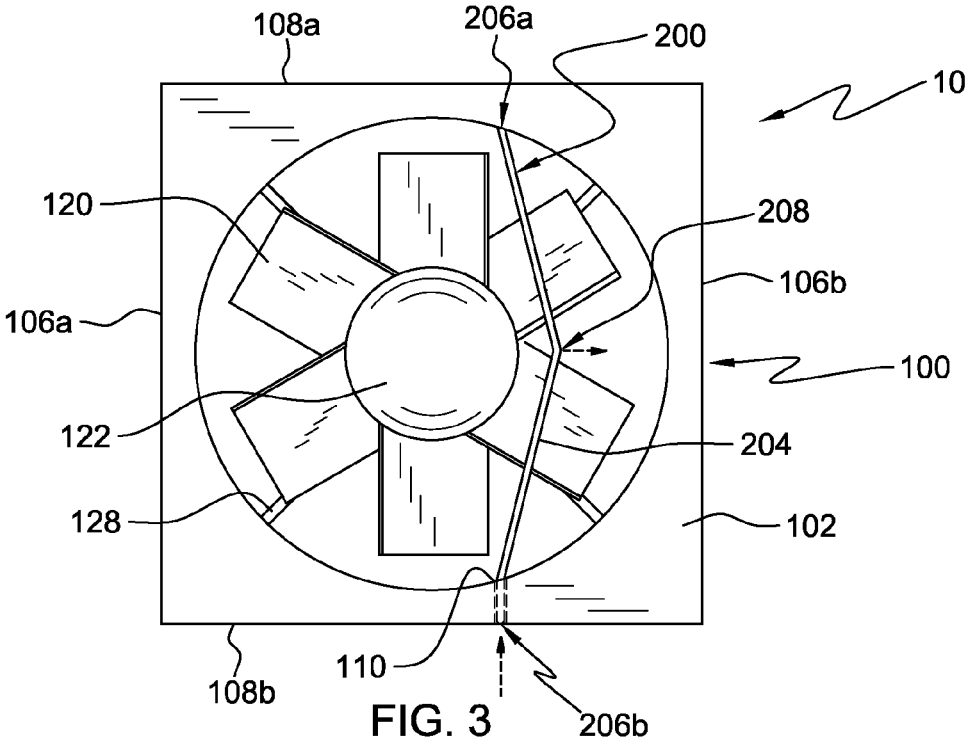
FIG. 3 depicts the fan brake of FIG. 1 after being fully seated within a housing according to the present invention.
Figure 10:
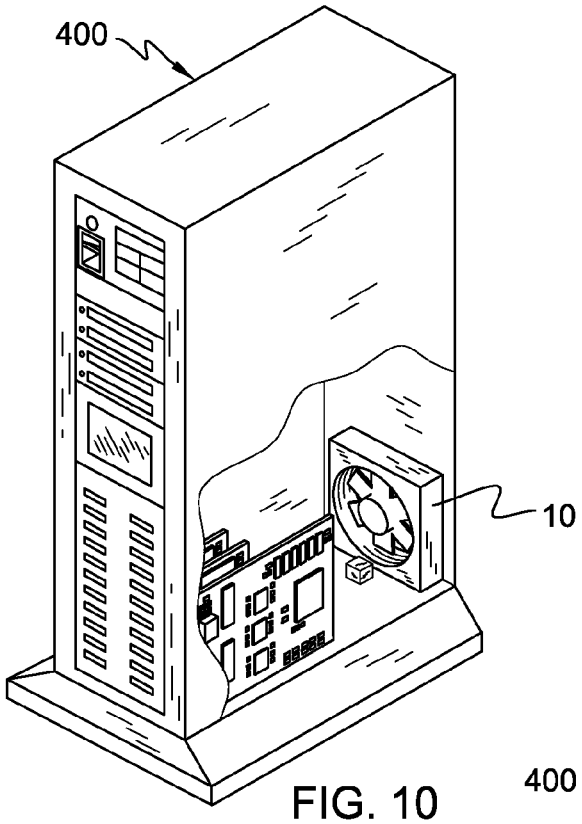
FIG. 10 depicts an example of a fan brake fully seated within a housing according to the present invention.

FIGS. 1-3 illustrates a fan brake for a fan assembly system generally designated 10 according to one embodiment of the present invention. FIGS. 1-3 provide only an illustration of one implementation and do not imply any limitations with regard to the environments in which different embodiments may be implemented. Many modifications to the depicted environments may be made. Although the examples may depict the fan assembly being seated into a computer housing, as seen in FIGS. 10 and 11, exemplary embodiments of the fan assembly may be implemented in any number of environments.

An embodiment of the fan assembly system 10 includes a fan assembly 100 and a fan brake 200, as depicted in FIGS. 1-3. The fan assembly 100 includes a fan housing 102. The fan housing 102 may be generally cuboidal in shape having first and second ends 104*a* and 104*b*, first and second sides 106*a* and 106*b*, and top and bottom sides 108*a* and 108*b*. In this example, all the sides of the fan housing 102 are generally planar. However, the fan housing 102 may be any number of other geometries and/or sizes, depending upon the geometry and/or size of the corresponding computer housing 400 the fan housing 102 is designed to seat into. The corners and/or edges of the fan housing 102 may be rounded to facilitate the insertion of the fan assembly 100 within a corresponding housing 400, and to reduce the likelihood that the housing may scratch an installer during insertion and/or removal.

Although this example of the fan housing 102 is made from a preformed plastic, other examples of the housing may be made of metal, fiberglass, etc. The first, second, top and bottom sides 106*a*, 106*b*, 108*a*, 108*b* are integral on this example. However, in other embodiments, the sides may be formed separately and joined through a known process, such as welding, etc.

Figure 11:
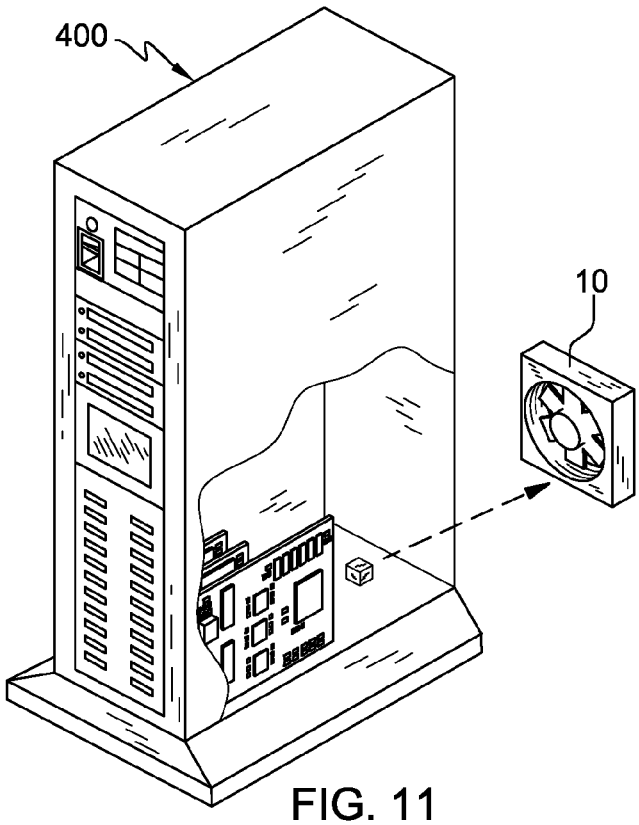
FIG. 11 depicts the fan brake of FIG. 10 prior to being fully seated within a housing according to the present invention.

The fan housing 102 includes an aperture 110 through which at least a portion of the fan brake 200 protrudes before the assembly 100 is fully seated within a computer housing 400, as seen in FIG. 11. In this example, the aperture 110 is located on the bottom side 108*b* of the fan housing 102. However, in other examples, the aperture 110 may be situated at other locations of the fan housing 102, as long as the aperture 110 allows proper functioning of the fan brake 200 when the fan assembly is fully seated within the computer housing 400, as seen in FIG. 10.

The fan housing 102 may include a blade guard (not shown) situated on the first and/or second ends 104*a* and 104*b* thereof. The blade guard may be of any number of geometries, such as mesh, etc. that helps prevent an individual from inserting their finger or another object within the interior of the fan housing 102.

One or more fan blades 120 extend from a center hub 122 in exemplary embodiments of the fan assembly 100. The fan blade 120 may be any number of geometries and/or sizes that fit within the corresponding fan housing 102. The fan hub 122 is generally cylindrical in geometry. Generally, at least one end of the fan hub 122 protrudes from a plane extending from the edges of the fan blades 120 to provide a surface the fan brake 200 may contact during use thereof. The fan blades 120 and the fan hub 122 are fabricated from plastics, metals, fiberglass, or other feasible materials. The fan blades 120 are integrally formed with the center hub 122 in most embodiments, although in some embodiments the fan blades 120 may be joined to the center hub 122 by other forms of connections. The center hub 122 may be connected to the fan housing 102 by the use of one or more brackets 128. However, in other embodiments, the center hub 122 is connected with the fan housing 102 by other known connecting means.

Figure 4:
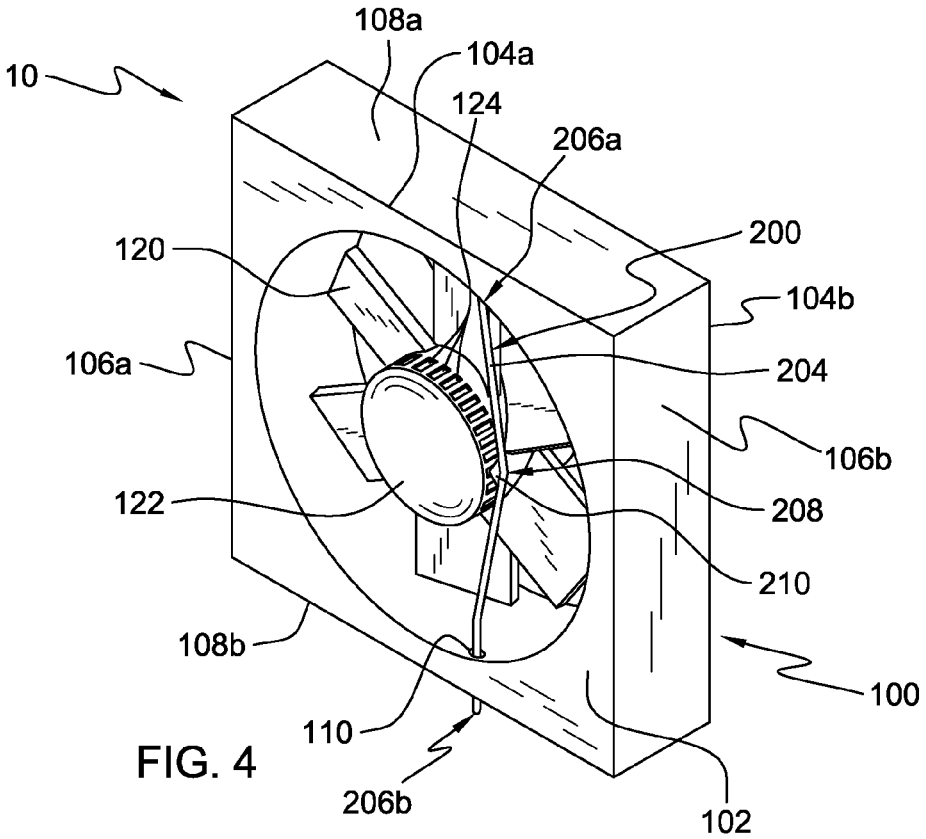
FIG. 4 depicts an example of a fan brake according to the present invention.

As seen in FIG. 4, the center hub 122 may include one or more notches 124 that impede the rotation of the fan blades 120 and hub 122 when the fan brake 200 is engaged. The notches 124 may be formed to mate with a braking member of the fan brake that leads to increased stopping force. In this example, the notches 124 are generally cuboidal, although other geometries of notches may be used to correspond with the geometry of the braking member used.

An exemplary embodiment of a fan brake 200 engaged with the center hub 122 is depicted in FIGS. 1-3. In this example, the fan brake 200 includes a member 204 with a first and second end 206*a* and 206*b*. In this example, the member 204 is integral from the first end 206*a* to the second end 206*b*. The member 204 may be cast or formed from metal, plastics, fiberglass, etc. In some examples, metal wire of common stock may be used to reduce the price of fabrication.

The member 204 may include a bend 208 or curvature along the length thereof. In some examples, the bend 208 may be located substantially toward the median of the member 204. The bend 208 facilitates the desired functioning of the fan brake 200 during use thereof. During use of the fan brake 200, when the second end 206*b* contacts a portion of the computer housing 400 when seating the fan assembly 100 within the computer housing 400, the force on the second end 206*b* presses the second end up towards the aperture 110 and biases the middle portion of the member away from the center hub 122, allowing the fan blades 120 and hub 122 to freely rotate, as depicted in FIG. 3.

The member 204 is connected to a portion of the housing at the first end 206*a*. In some examples, the member 204 may be connected to the housing by a connection that allows the member 204 to pivot. However, in other examples the member 204 may be connected to the fan housing 102 using other forms of connections. The connection may be a removable connection or a permanent connection. A removable connection may allow a user to more readily change the out the member 204 if a new or different member 204 is desired for use with a particular fan assembly 100. In this example, the first end 206*a* is connected with the top side 108*a* of the fan housing 102. However, in other examples, the first end 206*a* may be connected to other sides of the fan housing 102.

Figure 5:
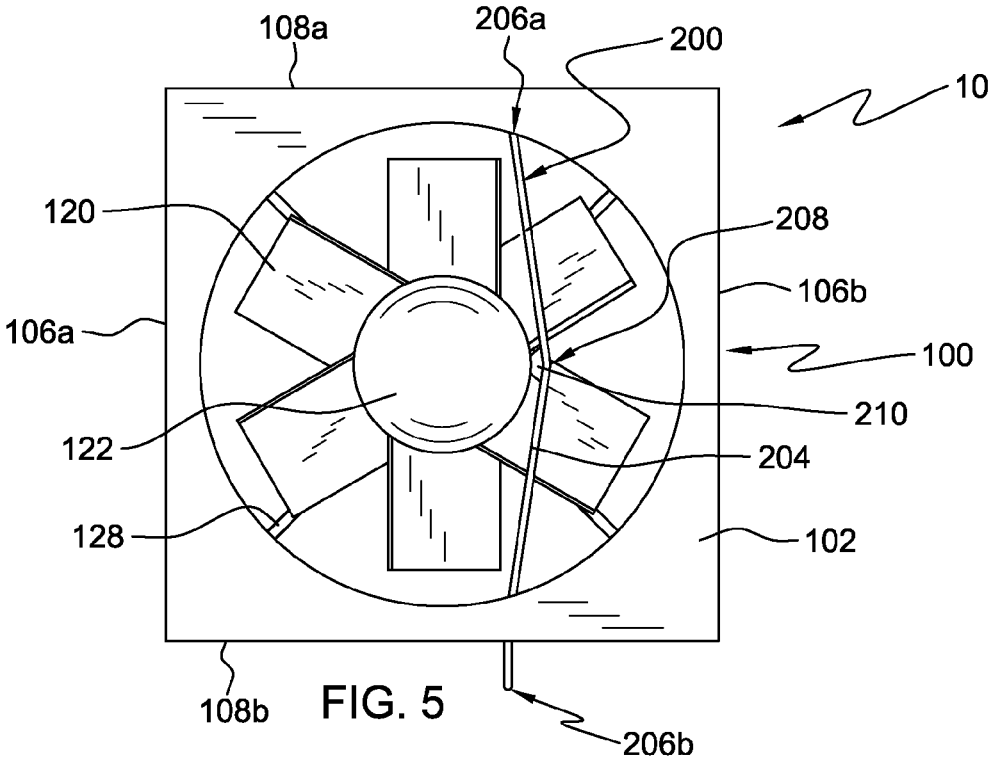
FIG. 5 depicts the fan brake of FIG. 4 prior to being fully seated within a housing according to the present invention.
Figure 6:
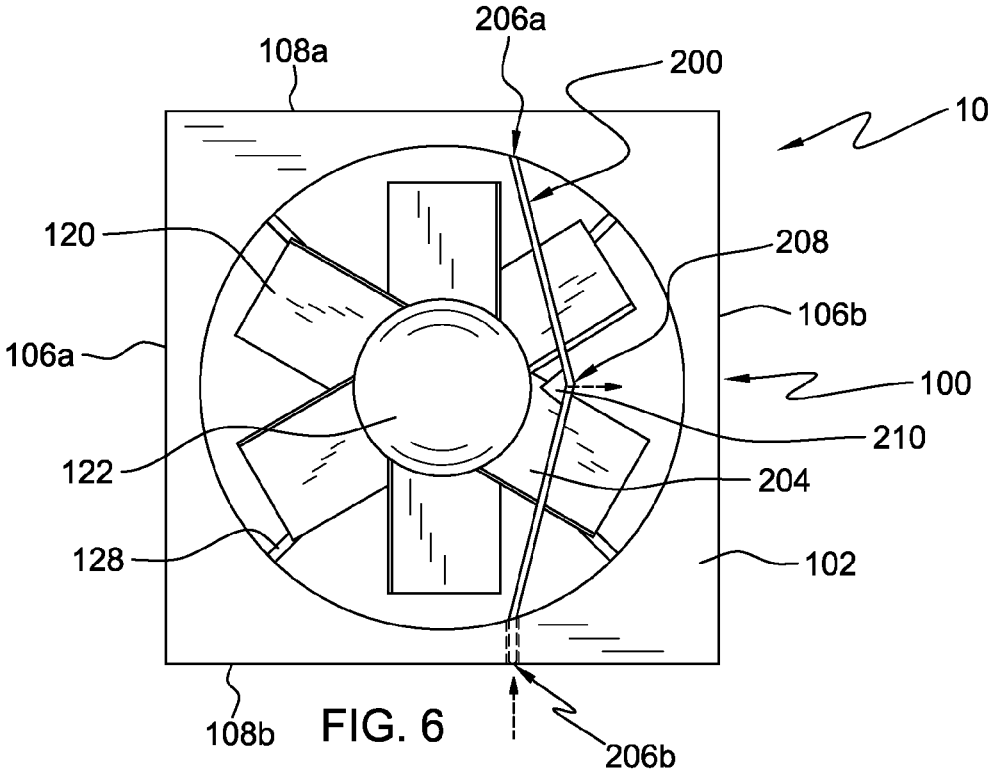
FIG. 6 depicts the fan brake of FIG. 4 after being fully seated within a housing according to the present invention.

In a second example, as depicted in FIGS. 4-6, the member 204 may include a body 210 that protrudes therefrom and facilitates the engagement of the member 204 with the center hub 122. The body 210 may also increase the life of the fan brake by providing a wear surface so that the rest of the member 204 does not weaken do to friction with the center hub 204. The body 210 may be formed integrally with the member 204 through a casting or fabrication process. However, in other examples, the body 210 may be joined with the member 204 by known processes. In some examples, the body 210 is fabricated from the same material as the member 204. However, in other examples, the body 210 is fabricated from a different material from the member 204 that has increased wear capabilities from frictional forces, etc. At least a portion of the body 210 and/or member 204 may be coated with special coatings to increase wear resistance or prevent corrosion or decay during use of the fan brake 200. The coatings may increase performance and/or longevity of the fan brake 200 by combating humidity and other corrosive elements.

As aforementioned, the second end 206*b* contacts a portion of the computer housing 400 when the fan housing 102 is fully seated within the computer housing 400. At this time, the contact between the computer housing 400 on the second end 206*b* presses the second end up towards the aperture 110 and biases the middle portion of the member 204 away from the center hub 122, allowing the fan blades 120 and hub 122 to freely rotate, as depicted in FIG. 3. On the converse, when the fan housing 102 is partially removed and is no longer fully seated within the corresponding computer housing 400, the second end 206*b* is allowed to protrude further away from the aperture 110 outwards of the fan housing 102 that biases the middle portion of the member 204 towards and contacting the center hub 122, effectuating an impedance of the rotation of the fan blades 120 and center hub 122, as depicted in FIG. 2.

Similarly, as depicted in FIGS. 6 and 10, the second end 206*b* contacts a portion of the computer housing 400 when the fan housing 102 is fully seated within the computer housing 400. At this time, the contact between the computer housing 400 on the second end 206*b* presses the second end up towards the aperture 110 and biases the middle portion of the member 204, along with the body 210 away from the notches 124 of the center hub 122, allowing the fan blades 120 and hub 122 to freely rotate. On the converse, when the fan housing 102 is partially removed and is no longer fully seated within the corresponding computer housing 400, the second end 206*b* is allowed to protrude further away from the aperture 110 outwards of the fan housing 102. The movement of the second end 206*b* outwards biases the middle portion of the member 204 and the body 210 towards and contacting the notches 124 of the center hub 122, effectuating an impedance of the rotation of the fan blades 120 and center hub 122, as depicted in FIGS. 5 and 11.

Figure 7:
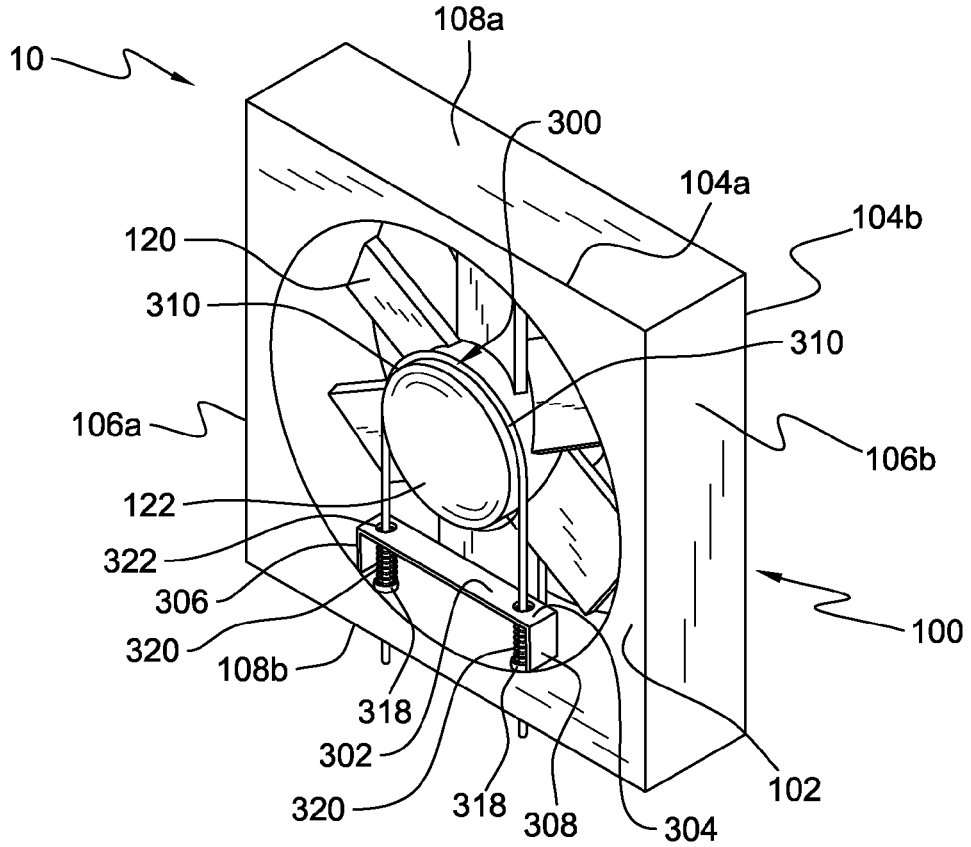
FIG. 7 depicts an example of a fan brake according to the present invention.
Figure 8:
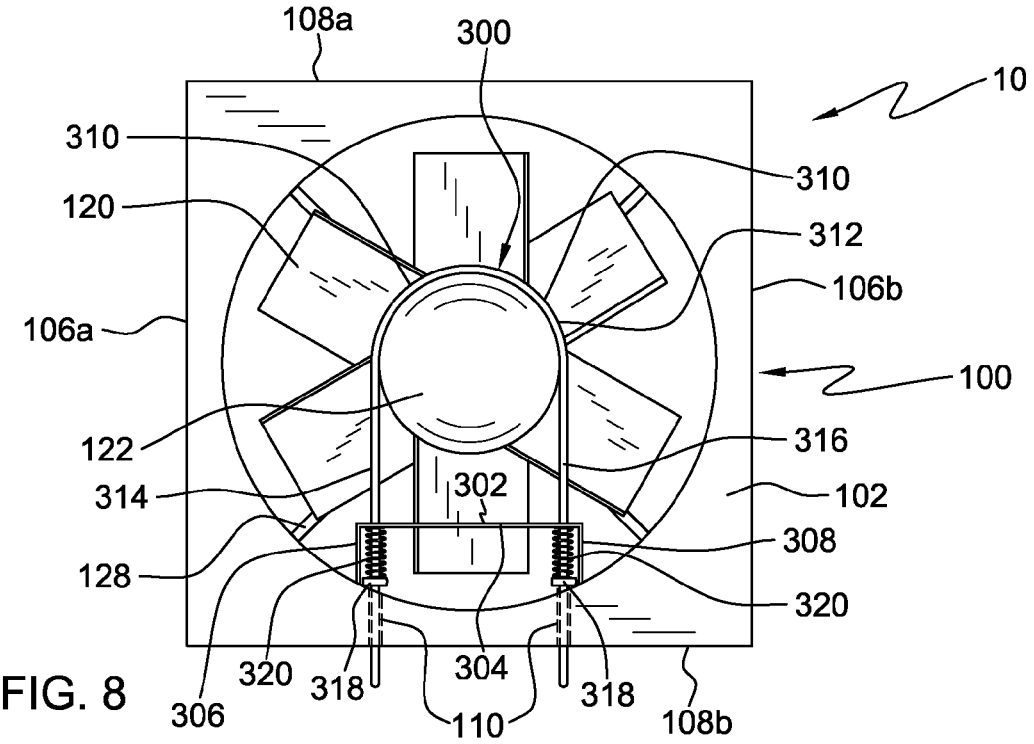
FIG. 8 depicts the fan brake of FIG. 7 prior to being fully seated within a housing according to the present invention.
Figure 9:
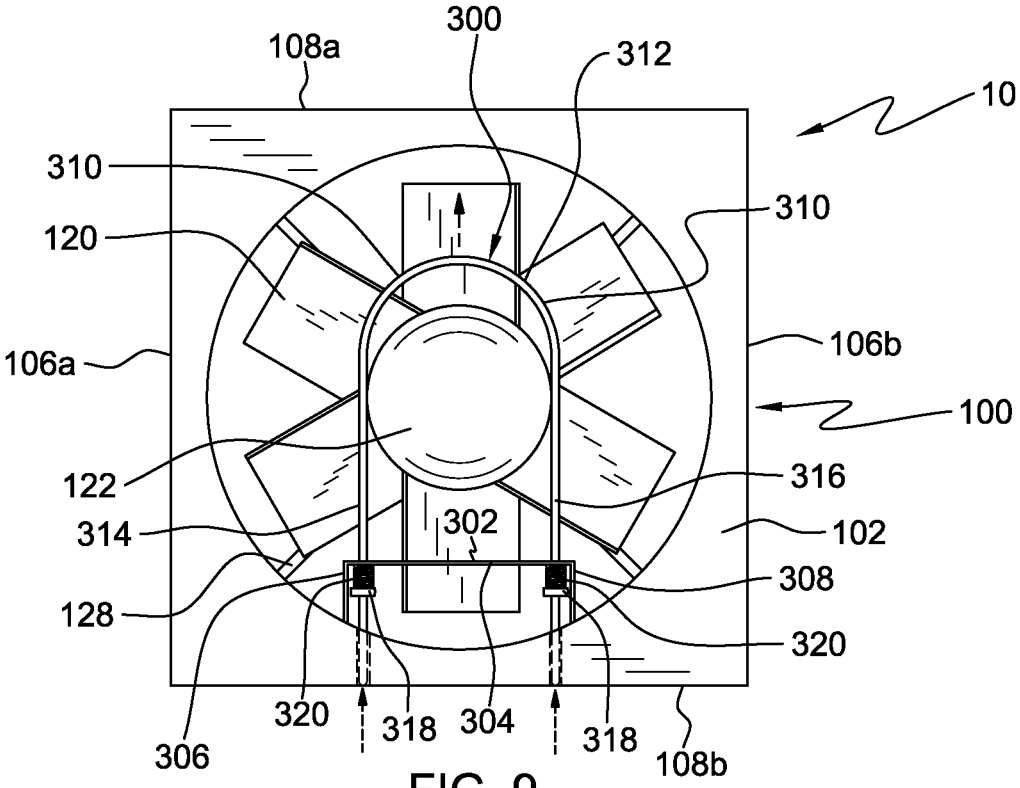
FIG. 9 depicts the fan brake of FIG. 7 after being fully seated within a housing according to the present invention.

In another embodiment, the fan brake 300 includes a platform 302, a generally U-shaped member 310, and one or more springs 320, as depicted in FIGS. 7-9. In this example, the platform 302 has an upper member 304 and two or more side members 306 and 308. The side members 306 and 308 may be integral with the upper member 304 during fabrication of the platform, or may be joined by known processes. In some examples, the platform 302 may be formed integrally with the fan housing 102 by molding or other known manufacturing methods. However, the platform 302 may be joined with the fan housing 102 by other known processes and/or connections, depending upon the type of materials used. The connection may be a removable connection or a permanent connection. A removable connection may allow a user to more readily change the out the platform 302 if a new or different platform 302 is desired for use with a particular fan assembly 100. During use of the fan brake 300, the platform 302 remains substantially stationary.

The platform 302 includes one or more apertures 322 used to facilitate desired functioning of the fan brake 300. In this example, the upper member 304 includes two apertures 322 that are substantially circular, with a diameter slightly larger than the outer diameter of the corresponding portion of the U-shaped member 310 that slides through the apertures 322 during operation of the fan brake 300. In other examples, the one or more apertures 322 may have different geometries and/or sizes to correspond with the exterior dimensions of the portion of the member 310 which slides through during operation of the fan brake 300.

In some examples, the lower face of the upper member 304 may include a raised surface (not shown) that facilitates alignment of the spring 320 by creating a recess in which an end of the spring 320 may seat. The raised surface may help center the spring 320 slide axially along a portion of the U-shaped member 310.

The U-shaped member 310 may include a curved portion 312 and two generally planar portions 314 and 316. The U-shaped member 310 may be fabricated from readily available sizes of round or other stock, thereby reducing manufacturing time and expense. The entire U-shaped member 310 is shown here to be substantially circular in shape, but other shapes are also possible. In some examples, the curved portion 312 may include a cross-sectional geometry that is different from the generally planar portions 314 and 316. The curved portion 312 is fabricated to a radius that is complementary to the curvature of the exterior of the fan hub 122. In some examples, the radius of curvature of the curved portion 312 is just larger than the radius of curvature of the fan hub 122, so that when the member 310 moves away relative to the platform 302, the generally planar portions 314 and 316 do not contact the fan hub 122.

In some examples, the planar portions 314 and 316 may include a protruding body 318 that facilitate alignment of the spring 320 by creating a surface in which an end of the spring 320 may seat. The protruding body 318 may help center the spring 320 slide axially along the planar portions 314 and 316 of the U-shaped member 310.

Typically, the spring 320 is a compression coil spring, but may also be another type of elastic element, such as an element comprised of visco-elastic polymer. As can be seen, the spring 320 biases the U-shaped member 310 towards the center hub 122 so that at least a section of the planar portions 314 and 316 protrude outside the fan housing 102 and at least a segment of the curved portion 312 engages the center hub. Therefore, when no (or an insufficient) contrary (compression) force is exerted against the end of the planar portions 314 and 316 protruding from the exterior of the fan housing 102, the curved portion 312 is engaged with the center hub 122, as depicted in FIG. 8. In such a configuration, the member 310 acts as a brake for the fan assembly 100.

Similarly, as depicted in FIG. 9, the end of the planar portions 314 and 316 contacts the computer housing 400 when the fan housing 102 is fully seated within the computer housing 400. At this time, the contact between the computer housing 400 on the ends of the planar portions 314 and 316 biases the U-shaped member 310 up through the aperture 110 along with biasing the curved portion 312 away from the center hub 122, allowing the fan blades 120 and hub 122 to freely rotate. On the converse, when the fan housing 102 is partially removed and is no longer fully seated within the corresponding computer housing 400, the end of the planar portions 314 and 316 are allowed to protrude further away from the aperture 110 outwards of the fan housing 102. The movement of the of the planar portions 314 and 316 outwards biases the curved portion 316 of the member 310 towards and contacting the center hub 122, effectuating an impedance of the rotation of the fan blades 120 and center hub 122, as depicted in FIG. 8.

Based on the foregoing, fan brake and assembly have been disclosed. However, numerous modifications and substitutions can be made without deviating from the scope of the present invention. Therefore, the present invention has been disclosed by way of example and not limitation.

What is claimed is:

1. An apparatus, comprising:

a fan assembly including a fan housing configured for seating into a cassette housing, and further including a fan having a plurality of blades connected with a fan hub internal to the fan housing;

a fan brake connected to the fan assembly, wherein the fan brake comprises:

a member with a first and second end, the member connected to a portion of the fan housing at the first end and passing through an aperture in the fan housing at the second end; and a bend along a length of the member;

wherein when the second end contacts a portion of the cassette housing when seating the fan assembly within the cassette housing, the force on the second end presses the second end towards the aperture and biases a middle portion of the member away from the fan hub, allowing the fan blades and hub to freely rotate.

2. The apparatus of claim 1, wherein the bend may be located substantially toward the median of the member.

3. The apparatus of claim 1, wherein the member is connected to the fan housing by a pivotable connection at a first end of the member.

4. The apparatus of claim 1, wherein the member is connected to the fan housing by a removable connection.

5. The apparatus of claim 1, wherein the member is connected to the fan housing by a permanent connection.

6. The apparatus of claim 1, wherein the first end is connected with a top side of the fan housing.

7. The apparatus of claim 1, wherein the fan brake further comprises:

a body connected to the member and protrudes therefrom for engaging the member with the fan hub.

8. The apparatus of claim 7, wherein the fan hub includes one or more notches that impede the rotation of the fan blades and hub when the fan brake is engaged.

9. The apparatus of claim 8, wherein the notches mate with the body of the fan brake to impede the rotation of the fan blades and hub when the fan brake is engaged.

10. An apparatus, comprising:

a fan assembly including a fan housing configured for seating into a cassette housing, and further including a fan having a plurality of blades connected with a fan hub internal to the fan housing;

a fan brake connected to the fan assembly, wherein the fan brake comprises:

a platform connected to the fan housing including one or more apertures;

a generally U-shaped member that includes a curved portion and two generally planar portions, the planer portions each passing through one of the one or more apertures and including a spring seating body; and for each planar portion, one or more springs positioned between the platform and the spring seating body;

wherein the spring seating body facilitates alignment of the spring by creating a surface in which an end of the spring may seat and centers the spring to slide axially along the planar portions and of the generally U-shaped member;

wherein in an disengaged position, an end of the planar portions contact the cassette housing when the fan housing is fully seated within the cassette housing and the contact between the cassette housing on the ends of the planar portions biases the U-shaped member up through the one or more apertures along with biasing the curved portion away from the fan hub, allowing the fan blades and hub to freely rotate; and wherein in an engaged position the fan housing is partially removed and is no longer fully seated within the corresponding cassette housing, the end of the planar portions are allowed to protrude further away from the one or more apertures outwards of the fan housing and movement of the of the planar portions outwards biases the curved portion of the member towards and contacts the center hub, effectuating an impedance of rotation of the fan blades and center hub.

11. The apparatus of claim 10, wherein the spring biases the U-shaped member towards the fan hub so that at least a section of the planar portions protrude outside the fan housing and at least a segment of the curved portion engages the fan hub.

12. The apparatus of claim 10, wherein the platform is formed integrally with the fan housing.

13. The apparatus of claim 10, wherein an upper member includes two apertures that are substantially circular, with a diameter slightly larger than the outer diameter of the corresponding portion of the U-shaped member that slides through the apertures during movement of the U-shaped member relative to the platform.

14. The apparatus of claim 10, wherein an upper member includes a raised surface that facilitates alignment of the spring by creating a recess in which an end of the spring may seat to center the spring and slide axially along a portion of the generally U-shaped member.

15. The apparatus of claim 10, wherein the entire length of the U-shaped member is substantially circular in cross-sectional geometry.

16. The apparatus of claim 10, wherein the curved portion has a radius of curvature that is complementary to the radius of curvature of the exterior of the fan hub.

17. The apparatus of claim 10, wherein a radius of curvature of the curved portion is just larger than a radius of curvature of the fan hub, so that when the generally U-shaped member moves away relative to the platform, the generally planar portions do not contact the fan hub.

18. The apparatus of claim 10, wherein the spring is a compression coil spring.

19. The apparatus of claim 10, wherein when an insufficient force is exerted against the end of the generally planar portions protruding from the exterior of the fan housing, the curved portion is engaged with the fan hub.

* * * * *